US011158951B2

(12) United States Patent
Quintero

(10) Patent No.: US 11,158,951 B2
(45) Date of Patent: Oct. 26, 2021

(54) ANTIPODAL VIVALDI ANTENNA SYSTEMS

(71) Applicant: SRI International, Menlo Park, CA (US)

(72) Inventor: Charles Edward Quintero, Bowie, MD (US)

(73) Assignee: SRI International, Menlo Park, CA (US)

( * ) Notice: Subject to any disclaimer, the term of this patent is extended or adjusted under 35 U.S.C. 154(b) by 322 days.

(21) Appl. No.: 16/435,126

(22) Filed: Jun. 7, 2019

(65) Prior Publication Data

US 2020/0388927 A1 Dec. 10, 2020

(51) Int. Cl.

| | |
|---|---|
| ***H01Q 13/08*** | (2006.01) |
| ***H01Q 1/38*** | (2006.01) |
| ***H01Q 1/50*** | (2006.01) |
| ***H01Q 9/04*** | (2006.01) |

(52) U.S. Cl.

CPC ..... *H01Q 13/085* (2013.01); *H01Q 1/38* (2013.01); *H01Q 1/50* (2013.01); *H01Q 9/0428* (2013.01)

(58) Field of Classification Search

CPC ..... H01Q 13/085; H01Q 9/0428; H01Q 1/50; H01Q 1/38; H01Q 1/08; H01Q 21/064; H01Q 21/24

See application file for complete search history.

(56) References Cited

U.S. PATENT DOCUMENTS 6,771,226 B1 * 8/2004 Dujmovic ..... H01Q 9/28 343/786
9,806,432 B2 * 10/2017 Little ..... H01Q 1/50
10,714,837 B1 * 7/2020 Rumsey ..... H01Q 21/064
2011/0057852 A1 * 3/2011 Holland ..... H01Q 21/064 343/795

OTHER PUBLICATIONS

"Iridium Satellite Constellation," Wikipedia, the Free Encyclopedia, last edited on May 29, 2019, accessed Jun. 7, 2019, 14 pp.
"Tracking and Data Relay Satellite," Wikipedia, the Free Encyclopedia, last edited on Feb. 25, 2019, accessed Jun. 7, 2019, 5 pp.
"Tracking and Data Relay Satellite System," Wikipedia, the Free Encyclopedia, last edited on Dec. 8, 2018, accessed Jun. 7, 2019, 7 pp.

* cited by examiner

*Primary Examiner* — Andrea Lindgren Baltzell
*Assistant Examiner* — Michael M Bouizza
(74) *Attorney, Agent, or Firm* — Shumaker & Sieffert, P.A.

(57) ABSTRACT

An example antenna system includes a connection member, a first pair of antipodal Vivaldi antennas, and a second pair of antipodal Vivaldi antennas. The first pair of antipodal Vivaldi antennas are coupled to the connection member, positioned co-planar with each other along a first plane, and inverted relative to each other. The first pair of antennas provide approximately 180 degrees of phase shift (frequency independent) for a first group of signals. The second pair of antipodal Vivaldi antennas are coupled to the connection member, positioned co-planar with each other along a second plane substantially orthogonal to the first plane, and inverted relative to each other. The second pair of antennas provide approximately 180 degrees of phase shift (frequency independent) for a second group of signals. The antenna system is configured to utilize the first and second pairs of antennas to transmit or receive signals with circular polarization.

20 Claims, 10 Drawing Sheets

705

ANTIPODAL VIVALDI ANTENNA SYSTEMS

TECHNICAL FIELD

This disclosure relates to antenna systems.

BACKGROUND

Current antenna panels, such as those used in space or satellite systems, are typically constructed as either mesh dish structures or as panels. Space systems often suffer the weight and size penalties that are associated with large, metal panel antennas. Examples of such metal panel antennas include Iridium antennas and Tracking and Data Relay Satellite (TDRS) antennas. Iridium antennas are space-based phased array systems that typically have relatively low gain, are heavy in weight, and are designed to use high power. Current antenna systems that are designed for use in outer space often have limited performance, especially with respect to size, weight, gain, bandwidth, losses, and rigidity.

SUMMARY

The present disclosure describes antenna arrays having systems that utilize two pairs of Vivaldi antennas, each pair of which are co-planar with and inverted relative to each other, such that each such pair of Vivaldi antennas is configured to provide approximately 180 degrees of phase shift for signals associated with that respective pair, independent of frequency. The approximate 180 degree phase shift is created because of the flipped orientation of the antenna elements in each pair, relative to one another, and not because of a path length difference between the two antennas. Therefore, the approximate 180 degree phase shift is independent of frequency, and close to exactly 180 degrees in many examples, within the tolerance of the antenna elements being co-planar and the path lengths being identical. This same concept can be applied for any element design. In various examples, Vivaldi elements are used because of their large bandwidth. These pairs of elements can then be added or subtracted in a hybrid, and as a result, these antenna systems and arrays are configured to transmit or receive signals with left or right circular polarization simultaneously. In some examples, the present disclosure describes a foldable Vivaldi antenna array that can be included in a satellite system for space-based applications. The foldable array can provide a beamforming network and power system that is integrated into the aperture of the array. The disclosed techniques can provide integration of analog or digital electronics into the aperture, and provide robust connection paths between the antenna elements while maintaining the polarization capabilities of the system or array for space-based applications. The antenna design can greatly increase the aperture efficiency for a lightweight, membrane-based antenna without the difficulties and weight that are often associated with multi-layer patch antennas.

In one example, an antenna system includes a connection member, a first pair of antipodal Vivaldi antennas, and a second pair of antipodal Vivaldi antennas. The first pair of antipodal Vivaldi antennas are each coupled to the connection member, are positioned co-planar with each other along a first plane, and are inverted relative to each other. The first pair of antipodal Vivaldi antennas provide approximately 180 degrees of phase shift, independent of frequency, for a first group of signals. The second pair of antipodal Vivaldi antennas are each coupled to the connection member, are positioned co-planar with each other along a second plane substantially orthogonal to the first plane when the antenna system is deployed, and are inverted relative to each other. The second pair of antipodal Vivaldi antennas provide approximately 180 degrees of phase shift, independent of frequency, for a second group of signals. The antenna system is configured to utilize the first and second pairs of antipodal Vivaldi antennas to transmit or receive signals with circular polarization at least by beamforming the first group of signals from the first pair of antipodal Vivaldi antennas, via at least one summing junction, to the second group of signals from the second pair of the antipodal Vivaldi antennas.

In another example, a foldable antenna array includes antenna systems that are interconnected via connection members, and a deployment actuator coupled to at least a group of the antenna systems. The deployment actuator is configured, upon actuation, to switch the foldable antenna array between a collapsed position and an expanded position for deployment. Each of the antenna systems includes at least one connection member, a first pair of antipodal Vivaldi antennas, and a second pair of antipodal Vivaldi antennas. The first pair of antipodal Vivaldi antennas are each coupled to the at least one connection member, positioned co-planar with each other along a first plane, and inverted relative to each other. The first pair of antipodal Vivaldi antennas provide approximately 180 degrees of phase shift, independent of frequency, for a first group of signals. The second pair of antipodal Vivaldi antennas are each coupled to the at least one connection member, positioned co-planar with each other along a second plane substantially orthogonal to the first plane when the foldable antenna array is in the expanded position, and inverted relative to each other. The second pair of antipodal Vivaldi antennas provide approximately 180 degrees of phase shift, independent of frequency, for a second group of signals. The antenna system is configured to utilize the first and second pairs of antipodal Vivaldi antennas to transmit or receive signals with circular polarization at least by beamforming the first group of signals from the first pair of antipodal Vivaldi antennas, via at least one summing junction, to the second group of signals from the second pair of the antipodal Vivaldi antennas.

In another example, a satellite system includes a satellite, a foldable antenna array including antenna systems that are interconnected via connection members, and a deployment actuator coupled to at least a group of the antenna systems. The deployment actuator is configured, upon actuation, to switch the foldable antenna array between a collapsed position and an expanded position for deployment. Each of the antenna systems includes at least one connection member, a first pair of antipodal Vivaldi antennas, and a second pair of antipodal Vivaldi antennas. The first pair of antipodal Vivaldi antennas are each coupled to the at least one connection member, positioned co-planar with each other along a first plane, and inverted relative to each other. The first pair of antipodal Vivaldi antennas provide approximately 180 degrees of phase shift, independent of frequency, for a first group of signals. The second pair of antipodal Vivaldi antennas are each coupled to the at least one connection member, positioned co-planar with each other along a second plane substantially orthogonal to the first plane when the foldable antenna array is in the expanded position, and inverted relative to each other. The second pair of antipodal Vivaldi antennas provide approximately 180 degrees of phase shift, independent of frequency, for a second group of signals. The antenna system is configured to utilize the first and second pairs of antipodal Vivaldi antennas to transmit or receive signals with circular polarization at least by beamforming the first group of signals from the first pair of antipodal Vivaldi antennas, via at least one summing junction, to the second group of signals from the second pair of the antipodal Vivaldi antennas.

The details of one or more examples are set forth in the accompanying drawings and the description below. Other features, objects, and advantages will be apparent from the description and drawings, and from the claims.

BRIEF DESCRIPTION OF DRAWINGS

FIG. 7A illustrates an expanded configuration, FIG. 7B illustrates an intermediate configuration, and FIG. 7C illustrates a collapsed or folded configuration.

DETAILED DESCRIPTION

Figure 1:
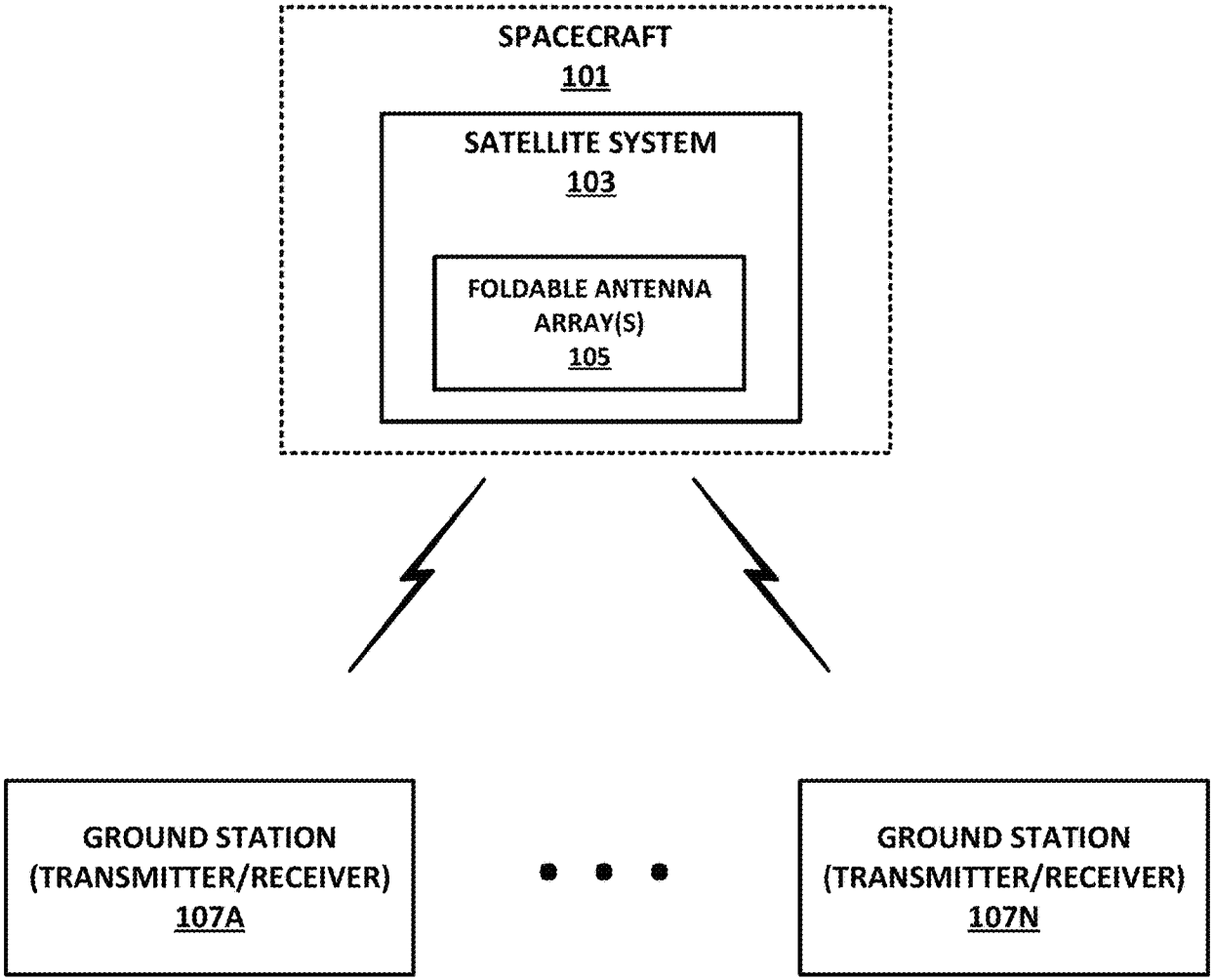
FIG. 1 is a diagram illustrating an example of one or more Vivaldi antenna systems that wirelessly communicate with one or more ground stations, in accordance with one or more aspects of the present disclosure.

As described above, current antenna panels, such as those used in space or satellite systems, are typically constructed as either mesh dish structures or as panels. Mesh reflector antennas are typically fragile, difficult to manufacture and deploy, require careful alignment with a feed horn, and often cannot evolve into an active beamformer. Panels are limited in gain, have narrower bandwidths, and are heavy and lossy.

Existing space and satellite systems often suffer the weight and size penalties that are associated with large, metal panel antennas. Examples of such metal panel antennas include iridium antennas and Tracking and Data Relay Satellite (TDRS) antennas. Iridium antennas are space-based phased array systems that typically have relatively low gain, are heavy in weight, and are designed to use high power.

Because small satellites are extremely constrained in their ability to collect solar energy, and are therefore limited in the amount of amplifier gain that can be added, the antenna gain is typically more important for these kinds of satellites than it is for regular communications satellites, such as those employing iridium-based antennas. The signal received or transmitted by the satellite is typically a combination of antenna gain and power available to amplify the signal above noise in the system. Increases in gain of the antenna can improve the link budget, and therefore can have a greater impact on signal-to-noise performance compared to amplifier gain. However, existing high-gain reflectors can only be pointed at a single direction, and do not typically provide electronic beam steering. In addition, existing large phased arrays, which can be electronically steered, are heavy and take a large amount of spacecraft volume prior to launch, and therefore the existing large phased arrays typically cannot be used on small satellites, especially cubesats.

The present disclosure describes antenna arrays having systems that include pairs of Vivaldi antennas that are each co-planar with and inverted relative to each other, such that each such pair of Vivaldi antennas is configured to provide approximately 180 degrees of phase shift, independent of frequency, for signals associated with that respective pair. As a result, these antenna systems and arrays are configured to transmit or receive signals with circular polarization. In various examples, the present disclosure describes a foldable Vivaldi antenna array that can be included in a satellite system for space-based applications.

A foldable array can enable folding of the array (e.g., in accordion style) along the diagonals, where beamformers combine signals along the layer of these diagonals. This enables the array to be folded up, such that signals do not have to cross other signals in the beamforming process. A minimization of these cross-overs can ensure robustness of the assembly in the stressing environment of space. In addition, the disclosed antenna designs use circular polarization to minimize the effect of Faraday rotation through the earth's ionosphere.

The disclosed antenna systems and arrays are compact, lightweight, high bandwidth, and high gain systems that can be steered over a large field of view, and when used with satellites (e.g., in small spacecraft), enable the satellites to communicate with a variety of small, portable ground stations without using their limited fuel to point their antennas. The foldable array can include low-noise amplifiers and be part of a beamforming network and power system that is integrated into the aperture of the array. The disclosed techniques can provide integration of analog or digital electronics into the aperture, and provide robust connection paths between the antenna elements while maintaining the polarization capabilities of the system or array for space-based applications. The antenna design can greatly increase the aperture efficiency for a lightweight, membrane-based antenna without the difficulties and weight that are often associated with multi-layer patch antennas.

In addition, the disclosed techniques can provide a distribution of electronics into each antenna system, or subarray, of the array. Rather than centralizing an electrical power system and electronics into a satellite bus, which adds substantial wire lengths, the disclosed antenna systems implement a new foldable Vivaldi system to distribute the electronic power system and electronics at the antenna system or subarray level, which reduces the overall size, weight, and power requirements of the phased array antenna design. Providing the ability to unfold large phased arrays for use with small satellites enables these satellites to be more useful in communications. In various examples, the new arrangement of antipodal Vivaldi elements provides approximately 9 dB of gain per antenna system (e.g., per quad system have four individual antipodal Vivaldi antennas), and these antenna systems are easily arrayed in the folded array design for higher gain. The beamforming approach simplifies combiner design, and the folding approach offers a simple mechanism, extreme compactness in the folded position, and excellent rigidity after deployment. The design is also adaptable for distributed transmit/receive modules and digital beamforming.

FIG. 1 is a diagram illustrating an example of one or more Vivaldi antenna systems that wirelessly communicate with one or more ground stations, in accordance with one or more aspects of the present disclosure. As illustrated in FIG. 1, one or more Vivaldi antenna systems can be included within one or more foldable antenna arrays 105. Antenna arrays 105 can have various applications, and can be used in various different structures. In the non-limiting example of FIG. 1, antenna arrays 105 are included in a satellite system 103, which can be located in outer space. Satellite system 103 uses antenna arrays 105 to communicate with one or more ground stations 107A-107N (collectively, "ground stations 107), which are located on Earth. Each of ground stations can include a transmitter and/or a receiver antenna system to wirelessly communicate with antenna arrays 105 of satellite system 103. The signals communicated between satellite system 103 and ground stations 107 can have circular polarization (e.g., right-handed circular polarization, left-handed circular polarization). For example, satellite system 103 can use antenna arrays 105 to transmit and receive signals having right-handed circular polarization, while ground stations 107 can be configured to transmit and receive signals having left-handed circular polarization. In certain cases, satellite system 103 can be included in a spacecraft 101 that is located in outer space.

As will be described in further detail below, antenna arrays 105 can include at least one foldable antenna array that serves as a compact, lightweight, active version of a Vivaldi array that can be folded up for the flight into space. The foldable array includes a group of antenna systems that are interconnected via connection members, and that further includes a deployment actuator coupled to at least some of the antenna systems. The deployment actuator is configured, upon actuation, to switch the foldable antenna array between a collapsed position and an expanded position for deployment. Each individual antenna system includes at least one connection member, a first pair of antipodal Vivaldi antennas, and a second pair of antipodal Vivaldi antennas.

The first pair of antipodal Vivaldi antennas are positioned co-planar with each other along a first plane and are inverted relative to each other, and they provide approximately 180 degrees of phase shift, independent of frequency, for a first group of signals. Similarly, the second pair of antipodal Vivaldi antennas are positioned co-planar with each other along a second plane and are inverted relative to each other, where the second plane is substantially orthogonal to the first plane, and where the second pair of antipodal Vivaldi antennas provide approximately 180 degrees of phase shift, independent of frequency, for a second group of signals. The second plane is orthogonal to the first plane when the antenna system is deployed. "Orthogonal," as used herein, may refer to a substantially right angle between two planes, where a substantially right angle may refer to a right angle that is greater than 89 degrees, greater than 85 degrees, greater than 80 degrees, or greater than 70 degrees, in certain examples. Each antenna system is configured to utilize the respective first and second pairs of antipodal Vivaldi antennas to transmit or receive signals with circular polarization at least by beamforming the first group of signals from the first pair of antipodal Vivaldi antennas, via at least one summing junction, to the second group of signals from the second pair of the antipodal Vivaldi antennas.

In these examples, the foldable array includes antipodal Vivaldi antenna elements, which are smaller in size (e.g., half the size) than microstrip fed elements, and also provide increased bandwidth of the lens or aperture. The described design also provides circular polarization for communicated signals, which enables its use for space communication in satellite system 103. To reduce the size and weight of active components, the design may, in various examples, incorporate chip and wire style components while achieving, e.g., 45-50 degrees of electronic steering.

Figure 2:
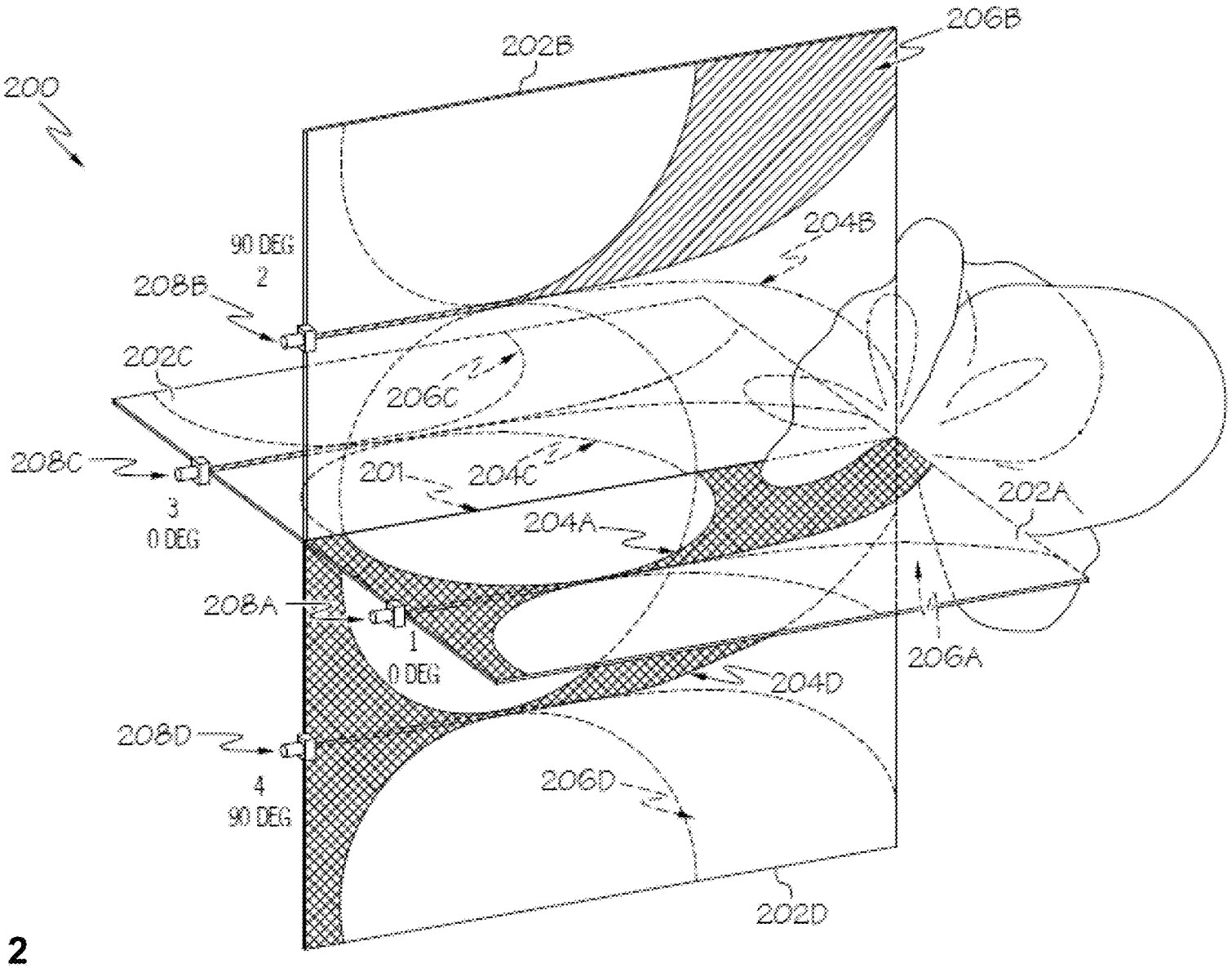
FIG. 2 is a diagram illustrating an example antenna system that includes first and second pairs of antipodal Vivaldi antennas, in accordance with one or more aspects of the present disclosure.

FIG. 2 is a diagram illustrating an example antenna system 200 that includes first and second pairs of antipodal Vivaldi antennas, in accordance with one or more aspects of the present disclosure. As shown in FIG. 2, antenna system 200 includes a first pair of antipodal Vivaldi antennas 202A and 202C (e.g., first and second antennas), which are each coupled to a connection member 201. Antenna system 200 further includes a second pair of antipodal Vivaldi antennas 202B and 202D (e.g., third and fourth antennas), which are each coupled to connection member 201. In non-limiting examples, antenna system 200 can provide approximately 9 decibels (dB) of gain.

Figure 3:
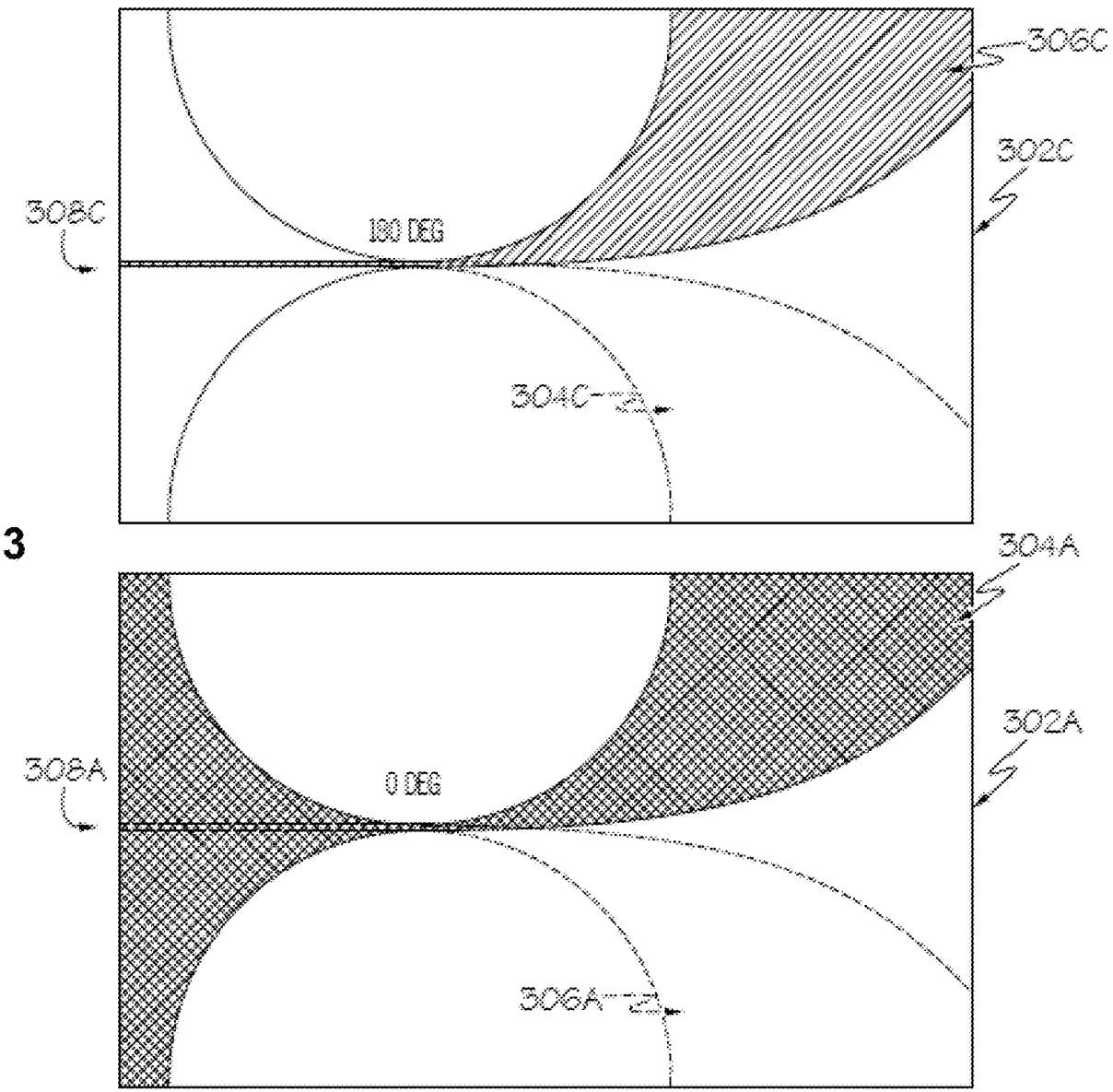
FIG. 3 is a diagram illustrating an example of one pair of antipodal Vivaldi antennas, in accordance with one or more aspects of the present disclosure.

Antennas 202A and 202C are positioned co-planar with each other along a first plane and are inverted relative to each other, such that antennas 202A and 202C provide approximately 180 degrees of phase shift, independent of frequency, for a first group of signals (e.g., such as also illustrated in the example of FIG. 3). Similarly, antennas 202B and 202D are positioned co-planar with each other along a second plane and are inverted relative to each other, such that antennas 202B and 202D provide approximately 180 degrees of phase shift, independent of frequency, for a second group of signals. The second plane in which antennas 202B and 202D are positioned is substantially orthogonal to the first plane in which antennas 202A and 202C are positioned when the antenna system 200 is deployed. Antenna system 200 is configured to utilize antennas 202A-202D (collectively, "antennas 202") to transmit or receive signals with circular polarization at least by beamforming the first group of signals from antennas 202A and 202C, via at least one summing junction (e.g., at least one junction included in or separate from array 200), to the second group of signals from antennas 202B and 202D. As will be described in further detail below regarding the use of antenna system 200 within a multi-system foldable array, antenna system 200 can be compacted by folding at the intersection of antennas 202.

In some examples, antenna system 200 is configured to beamform the first group of signals at least by being configured to combine a first portion of signals from antenna 202A with a second portion of signals from antenna 202C. Antenna system 200 is configured to beamform the second group of signals at least by being configured to combine a third portion of signals from antenna 202B with a fourth portion of signals from antenna 202D.

As indicated in FIG. 2, each of antennas 202 has a top side with a conductive leaf and a bottom side with a ground leaf. The terms "top side" and "bottom side" are used only to indicate side orientations that are relative to, and opposite from, one another. For example, antenna 202A has a top side with a conductive leaf 206A and a bottom side with ground leaf 204A. (In the orientation of antenna system 200 shown in FIG. 2, ground leaf 204A is actually on the side of antenna 202A that is facing upwards in the figure, although this side can be referred as a bottom side relative to the opposite side of antenna 202A having conductive leaf 206A.) Antenna 202C has a top side with a conductive leaf 206C and a bottom side with ground leaf 204C. As described above, antennas 202A and 202C are positioned co-planar with each other and are inverted relative to each other. Thus, the side having conductive leaf 206A of antenna 202A is adjacent to the side having ground leaf 204C of antenna 202C. The side having ground leaf 204A of antenna 202A is adjacent to the side having conductive leaf 206C of antenna 202C. Antennas 202A and 202C provide approximately 180 degrees of phase, independent of frequency, between the first portion of signals from antenna 202A and the second portion of signals from antenna 202C.

Antenna 202B has a top side with a conductive leaf 206B and a bottom side with ground leaf 204B. Antenna 202D has a top side with a conductive leaf 206D and a bottom side with ground leaf 204D. As described above, antennas 202B and 202D are positioned co-planar with each other and are inverted relative to each other. Thus, the side having conductive leaf 206B of antenna 202B is adjacent to the side having ground leaf 204D of antenna 202D. The side having ground leaf 204B of antenna 202B is adjacent to the side having conductive leaf 206D of antenna 202D. Antennas 202B and 202D provide approximately 180 degrees of phase, independent of frequency, between the third portion of signals from antenna 202B and the fourth portion of signals from antenna 202D.

As further shown in FIG. 2, each of antennas 202 includes a corresponding communication port. For example, antenna 202A includes a first communication port 208A, antenna 202B includes a second communication port 208B, antenna 202C includes a third communication port 208C, and fourth antenna 202D includes a fourth communication port 208D.

Communication port 208A includes a conductive element that is coupled to conductive leaf 206A of antenna 202A, and also includes a ground element that is coupled to ground leaf 204A of antenna 202A. Communication port 208B includes a conductive element that is coupled to conductive leaf 206B of antenna 202B, and also includes a ground element that is coupled to ground leaf 204B of antenna 202B. Communication port 208C includes a conductive element that is coupled to conductive leaf 206C of antenna 202C, and also includes a ground element that is coupled to ground leaf 204C of antenna 202C. Communication port 208D includes a conductive element that is coupled to conductive leaf 206D of antenna 202D, and also includes a ground element that is coupled to ground leaf 204D of antenna 202D.

In some examples, such as the one illustrated in FIG. 2, each communication port is positioned substantially in the middle of one end of the respective antenna. Thus, communication port 208A of FIG. 2 is positioned substantially in the middle of one end (e.g., the left end of FIG. 2) of antenna 202A. Similarly, communication port 208B is positioned substantially in the middle of one end of antenna 202B. Communication port 208C is positioned substantially in the middle of one end of antenna 202C, and communication port 208D is positioned substantially in the middle of one end of antenna 202D. Each of communication ports 208A-208D (collectively, "communication ports 208") can be communicatively coupled to a respective feedline (e.g., coaxial cable).

The respective feedlines for communication ports of co-planar antennas in antenna system 200 can be coupled to a common conductive source and a common ground for these antennas. For example, the respective feedlines for communication ports 208A and 208C, which are part of respective co-planar antennas 202A and 202C, can be coupled to a common conductive source and a common ground. The common conductive source can then be communicatively coupled to each of conductive leaves 206A and 206C, while the common ground can be communicatively coupled to each of ground leaves 204A and 204C.

Similarly, the respective feedlines for communication ports 208B and 208D, which are part of respective co-planar antennas 202B and 202D, can be coupled to a common conductive source and a common ground for these antennas. The common conductive source can then be communicatively coupled to each of conductive leaves 206B and 206D, while the common ground can be communicatively coupled to each of ground leaves 204B and 204D.

In the example of FIG. 2, antenna system 200 is configured to utilize the first pair of antennas 202A and 202C, along with the second pair of antennas 202B and 202D, to transmit or receive the signals with circular polarization by providing an approximate 90 degrees phase shift of signals between antenna 202A and 202B, an approximate 180 degrees phase shift of signals between antennas 202A and 202C, an approximate 270 degrees phase shift of signals between antennas 202A and 202D, and an approximate 90 degrees additional phase shift of signals between antennas 202D and 202A.

In various examples, antenna system 200 can be configured to transmit or receive signals with right-hand or left-hand circular polarization. For example, antenna system 200 can be configured to transmit or receive signals with right-hand circular polarization by adding a first portion of signals from antenna 202A with a second portion of signals from antenna 202C, and by adding a third portion of signals from antenna 202B with a fourth portion of signals from antenna 202D. In another example, antenna system 200 can be configured to transmit or receive signals with left-hand circular polarization by subtracting signals of one of antenna 202A or 202C from the other, and by subtracting signals of one or antenna 202B or 202D from the other.

FIG. 3 is a diagram illustrating an example of one pair of antipodal Vivaldi antennas 302A and 302C of an antenna system, in accordance with one or more aspects of the present disclosure. Antennas 302A and 302C can be one example of antipodal Vivaldi antennas 202A and 202C shown in FIG. 2. Antennas 302A and 302C can also be one example of antipodal Vivaldi antennas 202B and 202B shown in FIG. 2.

Antennas 302A and 302C of FIG. 3 are positioned co-planar with each other along a first plane and are inverted relative to each other, such that antennas 302A and 302C provide approximately 180 degrees of phase shift, independent of frequency, for a group of signals associated with these antennas. Antennas 302A and 302C are inverted in that antenna 302C is oriented as a reflected duplicate of antenna 302A, relative to their common edge (in FIG. 3, the top edge of antenna 302A and the bottom edge of antenna 302C). Antenna 302A includes a ground leaf 304A and a conductive leaf 306A. Antenna 302A further includes a communication port 308A having a conductive element that is coupled to conductive leaf 306A, and also having a ground element that is coupled to ground leaf 304A. Antenna 302C includes a ground leaf 304C and a conductive leaf 306C. Antenna 302C further includes a communication port 308C having a conductive element that is coupled to conductive leaf 306C, and also having a ground element that is coupled to ground leaf 304C.

Antennas 302A and 302C illustrate an example antenna pair that can be used in the antenna system 200 shown in FIG. 2. Providing the approximate 180 degrees of phase shift, independent of frequency, for signals associated with antennas 302A and 302C enables wideband performance for the system. Traditional antenna systems can use meander lines to create the 180 degrees phase shift, which introduces group delay, where causing a phase shift away from a narrowly designed frequency of operation. Even short meanders to implement the 180 degrees phase shift can dramatically limit the bandwidth. However, utilizing the techniques of the present disclosure, including the antenna pair 302A, 302C that can be implemented in the antenna system 200 of FIG. 2, group delay can be significantly reduced, and in some cases effectively eliminated, and there would be no group delay induced axial ratio problems. Instead, antenna system 200 is enabled to provide signal output that maintains the circular polarization irrespective of frequency.

Figure 4:
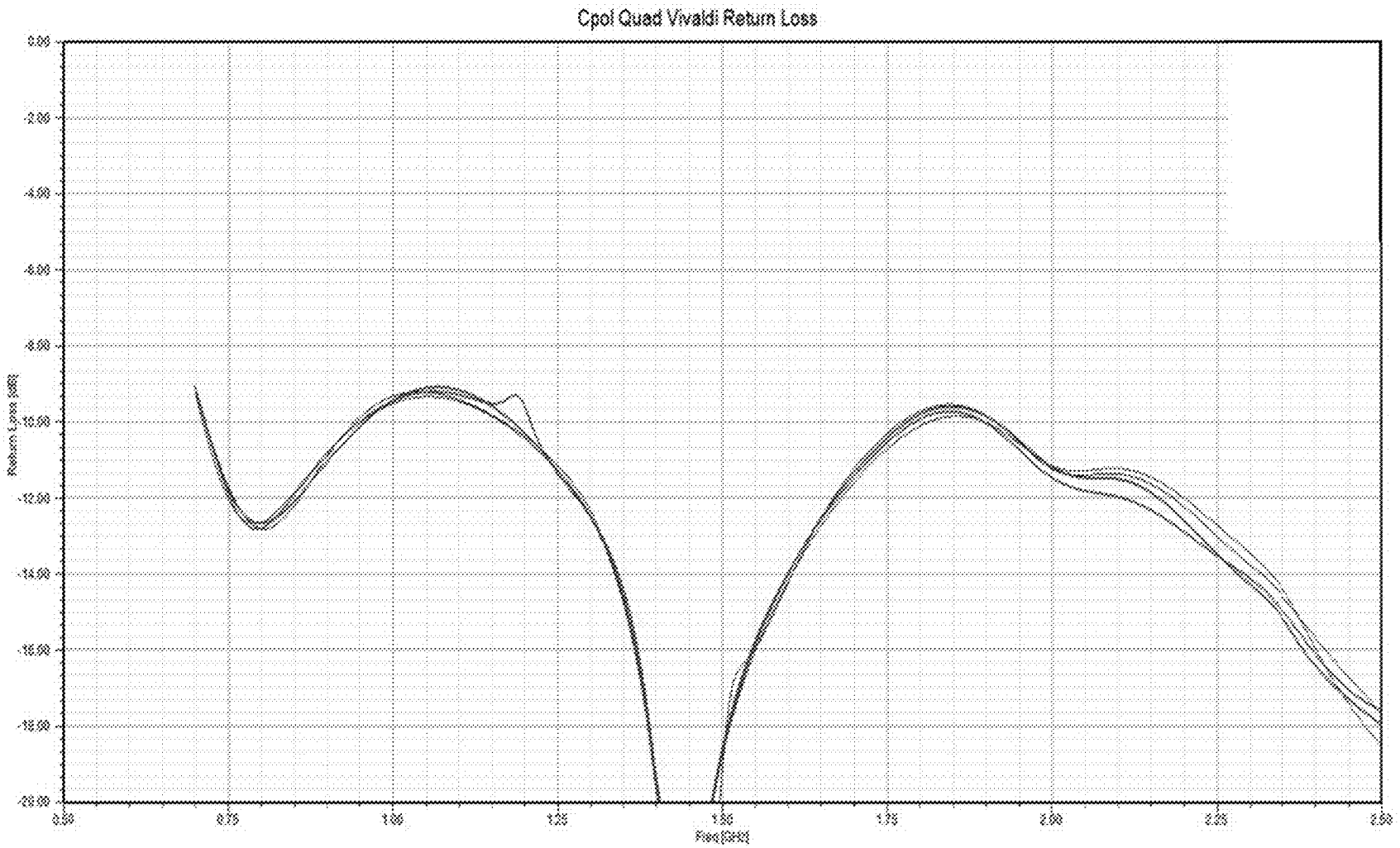
FIG. 4 is a graph diagram illustrating example return loss curves for an antenna system having first and second pairs of antipodal Vivaldi antennas, in accordance with one or more aspects of the present disclosure.

FIG. 4 is a graph diagram illustrating example return loss curves for an antenna system having first and second pairs of antipodal Vivaldi antennas, in accordance with one or more aspects of the present disclosure. For example, FIG. 4 shows example return loss curves, as a function of frequency, for antenna system 200 of FIG. 2, which includes antennas 202A-202D.

In FIG. 4, four different return loss curves are shown. Each curve is associated with a respective one of communication ports 208 illustrated in FIG. 2, wherein communication port 208A is included in antenna 202A, communication port 208B is included in antenna 202B, communication port 208C is included in antenna 202C, and communication port 208D is included in antenna 202D. The four return loss curves are similar in shape, where the x-axis represents a frequency range in Gigahertz (GHz), and where the y-axis represents a return loss range in decibels (dB).

As indicated in FIG. 4, the return loss for antenna system is quite low. For example, FIG. 4 indicates that the return loss is substantially less than −10 dB over an approximately three frequency octave range. FIG. 4 further indicates that antenna system 200 operates very well, with little return loss, in the L-band region of approximately 1-2 GHz, which is the frequency range in which many global positioning satellite and satellite links operate.

Figure 5B:
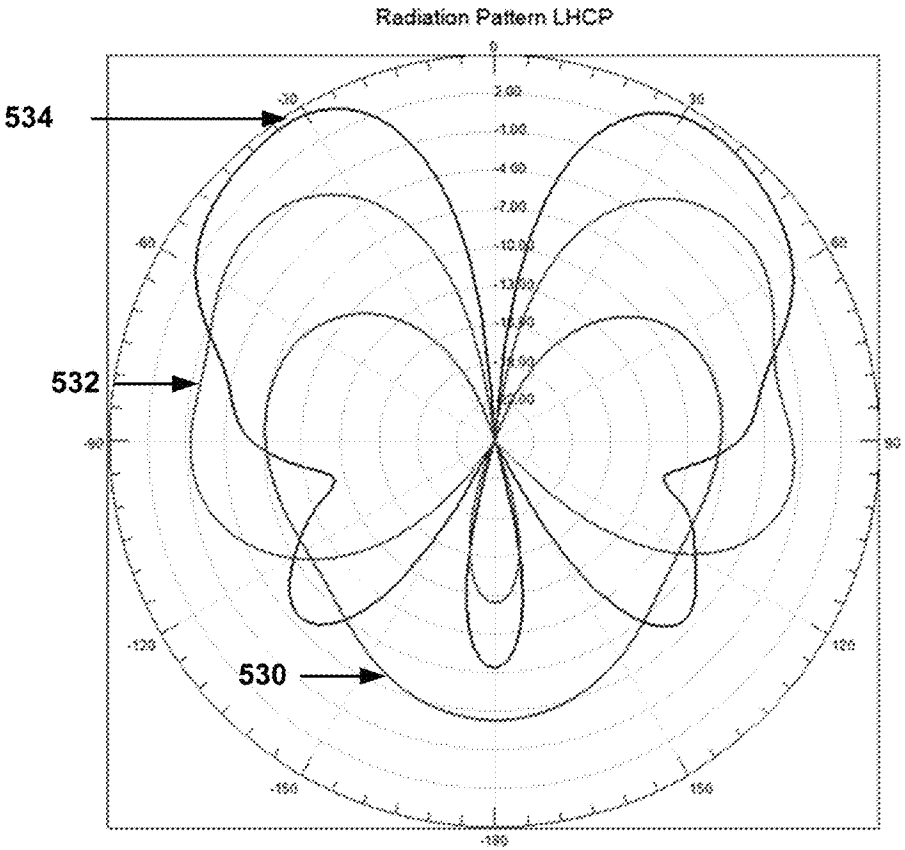
FIGS. 5A-5B are graph diagrams illustrating example radiation pattern curves for an antenna system having first and second pairs of antipodal Vivaldi antennas, in accordance with one or more aspects of the present disclosure.
Figure 5A:
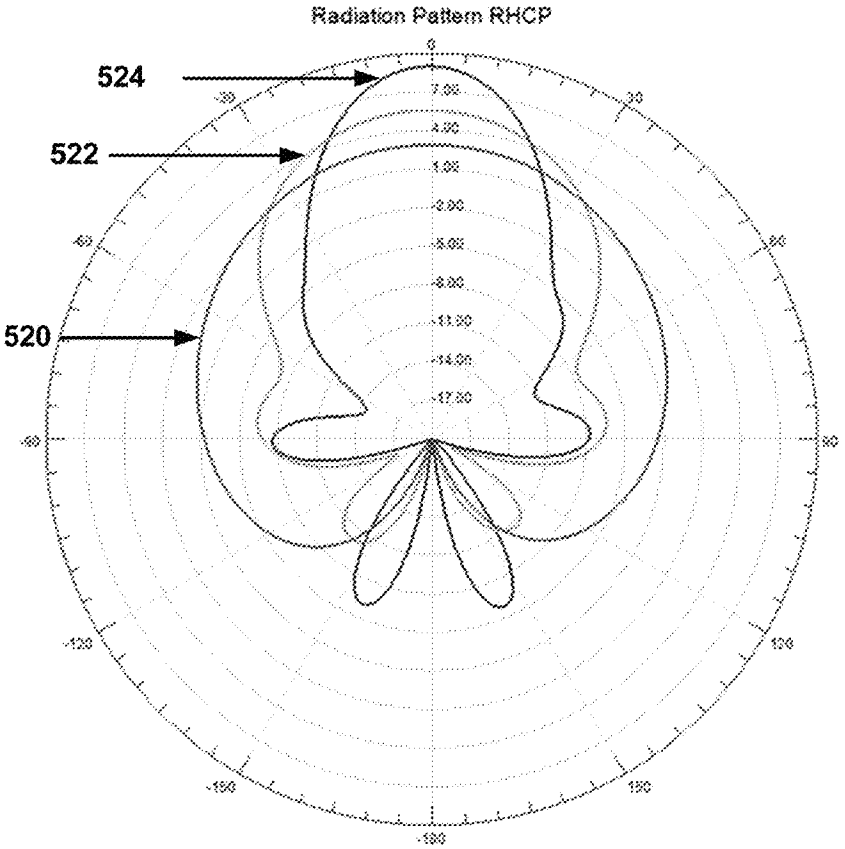

FIGS. 5A-5B are graph diagrams illustrating example radiation and gain pattern curves for an antenna system having first and second pairs of antipodal Vivaldi antennas, in accordance with one or more aspects of the present disclosure. For example, the example radiation curves shown in these figures may be associated with antenna system 200 of FIG. 2, which includes antennas 202.

FIG. 5A illustrates the radiation and gain pattern curves for the transmit operations of antenna system 200. In many instances, satellite systems having antenna systems, such as antenna system 200, transmit signals using right-hand circular polarization and receive signals using left-hand circular polarization. (Ground stations on the other hand, such as ground stations 107, typically transmit signals using left-hand circular polarization and receive signals using right-hand circular polarization.) Thus, the curves illustrated in FIG. 5A can correspond to the transmission of signals having right-hand circular polarization. Curves 520, 522, and 524 correspond to distinct radiation and gain patterns for different frequencies illustrated in FIG. 4. For instance, curve 520 corresponds to a lower frequency value shown in FIG. 4 (e.g., 0.75 GHz), curve 522 corresponds to an intermediate frequency value shown in FIG. 4 (e.g., 1.0 GHz), and curve 524 corresponds to a higher frequency value shown in FIG. 4 (e.g., 2.0 GHz). These curves shown gain patterns for the signal transmission from antenna system 200, where curve 524 illustrates a gain of approximately 9 dB.

FIG. 5B illustrates the radiation and gain patterns for the receipt of signals having left-hand circular polarization by antenna system 200. Similar to the curves shown in FIG. 5A, curves 530, 532, and 534 correspond to distinct radiation and gain patterns for different frequencies illustrated in FIG. 4. For instance, curve 530 corresponds to a lower frequency value shown in FIG. 4 (e.g., 0.75 GHz), curve 532 corresponds to an intermediate frequency value shown in FIG. 4 (e.g., 1.0 GHz), and curve 534 corresponds to a higher frequency value shown in FIG. 4 (e.g., 2.0 GHz). These curves shown gain patterns for the signal transmission from antenna system 200, where curve 524 illustrates an isolation down to approximately −20 dB, indicating that less than approximately 1% of the energy leaks through to the receive side. The radiation patterns illustrated in FIGS. 5A and 5B illustrate approximately 30 dB of overall cross polarization isolation between transmit signals (FIG. 5A) and receive signals (FIG. 5B) for antenna system 200.

Figure 6:
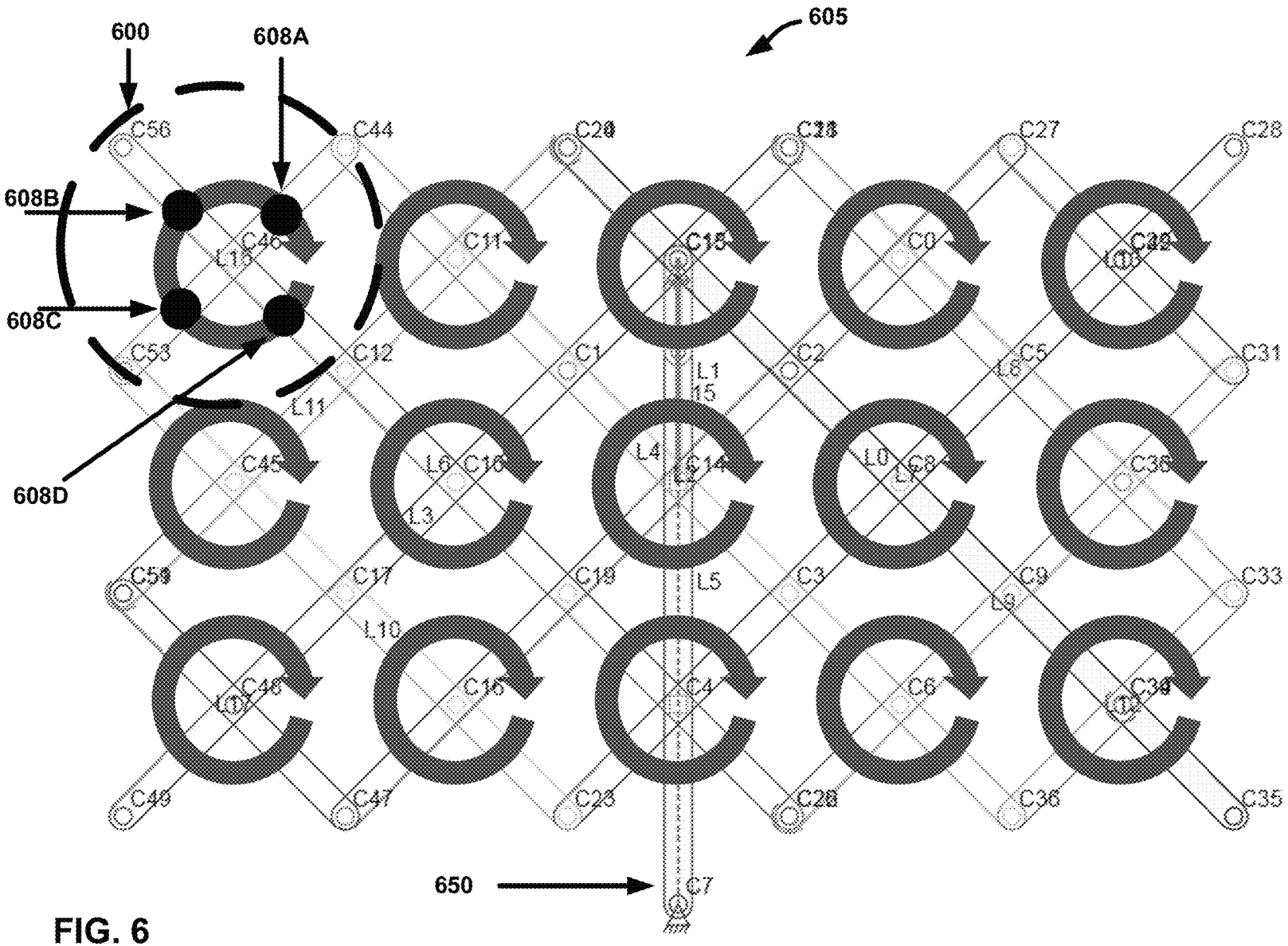
FIG. 6 is a diagram illustrating an example antenna array having multiple interconnected antenna systems that provide an array factor gain, in accordance with one or more aspects of the present disclosure.

FIG. 6 is a diagram illustrating an example antenna array 605 having multiple interconnected antenna systems that provide an array factor gain, in accordance with one or more aspects of the present disclosure. As will be described further below, antenna array 605 can be a foldable antenna array that includes multiple different antenna systems that are interconnected via connection members. Antenna array 605 can be one example of antenna array 105 shown in FIG. 1.

For example, antenna array 605 can include antenna system 600 and multiple other similar antenna systems within array 605, where each antenna system comprises an antipodal Vivaldi antenna system such as described in reference to FIGS. 2-5. For instance, individual antenna system 600 within antenna array 605 can be one example of antenna system 200 shown in FIG. 2. Each antenna system, such as antenna system 600, can include respective pairs of antennas (e.g., antenna pair 202A and 202C; antenna pair 202B and 202D), where each pair of antennas are positioned co-planar with each other and provide approximately 180 degrees of phase shift, independent of frequency, for a group of signals associated with this antenna pair. In the example of FIG. 6, antenna array 605 includes fifteen distinct and interconnected antenna systems.

Each antenna system within array 605 can include four respective communication ports, which can each correspond to one of communication ports 208 shown in FIG. 2. For example, antenna system 600 in array 605 can include communication ports 608A-608D (collectively, "communication ports 608), which can be examples of communication ports 208 shown in FIG. 2. In FIG. 6, each antenna system, such as antenna system 600, can be processing signals having right-hand circular polarization, as indicated in the figure. In other examples, the antenna systems of antenna array 605 can be configured to process signals having left-hand circular polarization.

FIG. 6 shows various connection members and linkages within antenna array 605. One or more of these connection members are indicated by a capital C followed by a number (e.g., "C44"). One or more of the linkages within array 605 is indicated by a capital L followed by a number (e.g., "L11"). As indicated in FIG. 6, antenna system 600 includes at least one connection member C46 that couples the individual antipodal Vivaldi antennas of antenna system 600 to one another. In addition, antenna system 600 is coupled to other antenna systems in array 605 via one or more additional connection members and/or linkages.

For instance, antenna system 600 is coupled to first other antenna system in array 605 via connection member C44. Antenna system 600 is coupled to a second other antenna system in array 605 via connection member C12. In addition, antenna system 600 is coupled to a third other antenna system in array 605 via connection member C53. Every antenna system in array 605 is similarly coupled to one or more other antenna systems within array 605. In addition, the antenna systems in array 605 are interconnected via one or more corresponding linkages, as illustrated in FIG. 6.

Figure 7A:
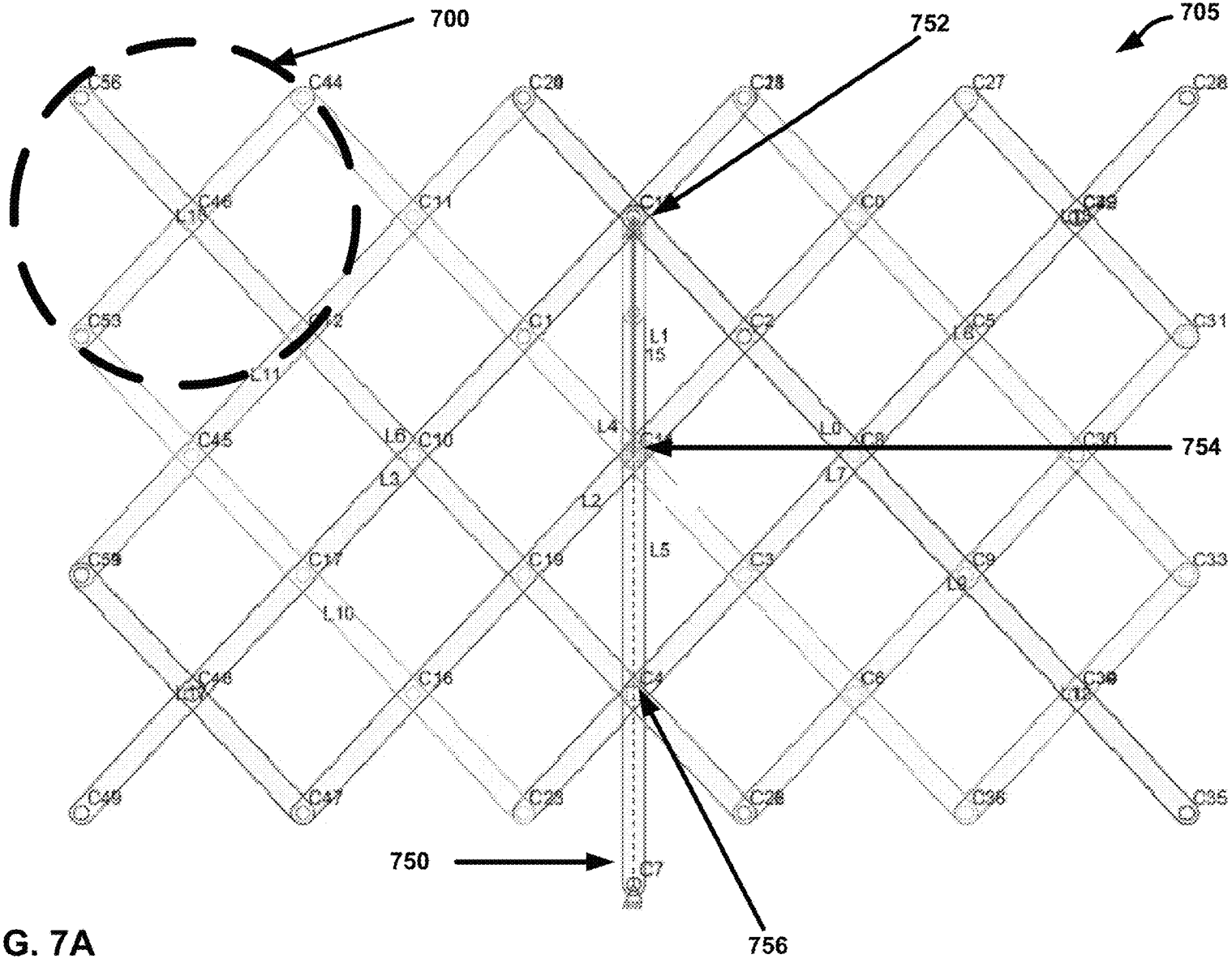
FIGS. 7A-7C are diagrams that illustrate an example of a foldable Vivaldi antenna array having multiple different configuration.
Figure 7B:
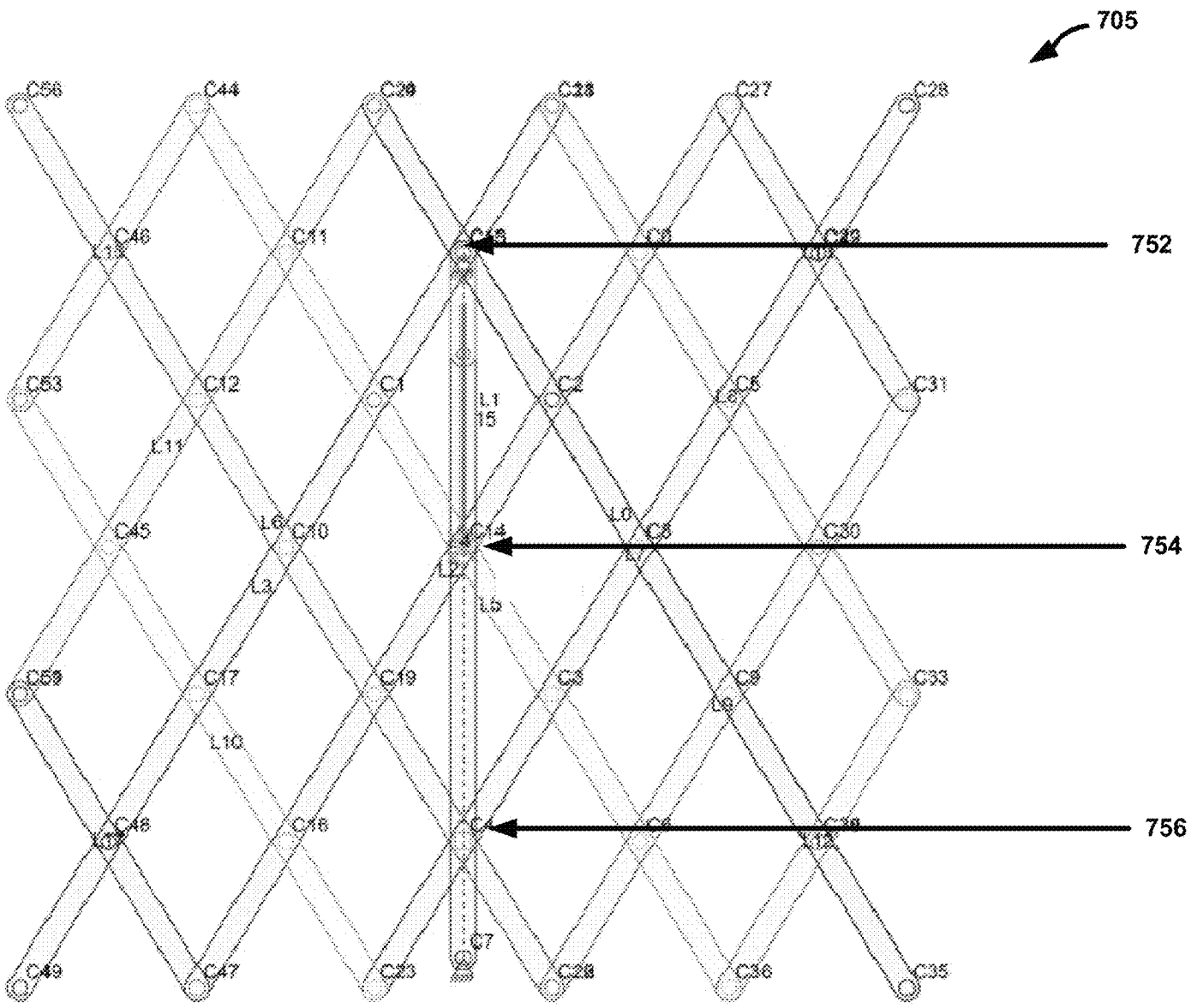
Figure 7C:
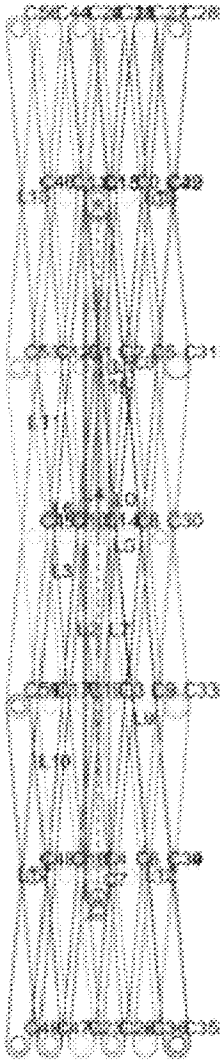

Antenna array 605 further includes a deployment actuator 650 that is coupled to at least some of the antenna systems in array 605. Deployment actuator 650 is configured, upon actuation, to switch antenna array 605 between a collapsed position and an expanded position for deployment, as illustrated in FIGS. 7A-7C.

Antenna array 605 can be compacted by folding at the array element plane intersections. This flattened version of the lens can then be folded further, like an accordion, and fit into the cubesat of a satellite (e.g., satellite system 103).

For example, array 605 can be collapsed or expanded via actuation of deployment actuator 650 (e.g., motion of deployment actuator 650 and/or of a tensile member running through or within deployment actuator 650), causing corresponding folding or expansion of antenna system elements within array 605 at select top-side connection members (C44, C20, C21, C27), right-side connection member (C31, C33), bottom-side connection members (C36, C26, C23, C47), and left-side connection members (C59, C53).

Deployment actuator 650 can be coupled to the antenna systems in array 605 via summing junctions at C4, C14, and C15. These junctions can also comprise feedline ports as shown further in FIGS. 7A-7C and FIG. 8. As noted above, antenna array 605 includes fifteen distinct antenna systems, including antenna system 600. In various examples, the arrangement of antipodal Vivaldi antennas within the antenna systems of array 605 can provide approximately 9 dB of gain for each antenna system (e.g., antenna system 600). However, given that the antenna systems are combined within array 605, there is an additional realized array factor gain for array 605 of approximately 11.8 dB, thereby providing a total gain for array 605 of approximately 20.8 dB. The folding approach enabled by array 605 provides a simple mechanism to collapse or deploy array 605, where array has an extreme compactness in the folded position, but also provides excellent rigidity after deployment. In addition, as shown in FIGS. 7A-7C and FIG. 8, and described in further detail below, the beamforming approach to combine signals from the antenna systems of array 605 can provide a simplified combiner design, and this design can also be adapted for distributed transmitter/receiver modules and digital beamforming.

FIGS. 7A-7C are diagrams that illustrate an example of a foldable Vivaldi antenna array 705 having multiple different configuration. FIG. 7A illustrates an expanded configuration, FIG. 7B illustrates an intermediate configuration, and FIG. 7C illustrates a collapsed or folded configuration.

Figure 8:
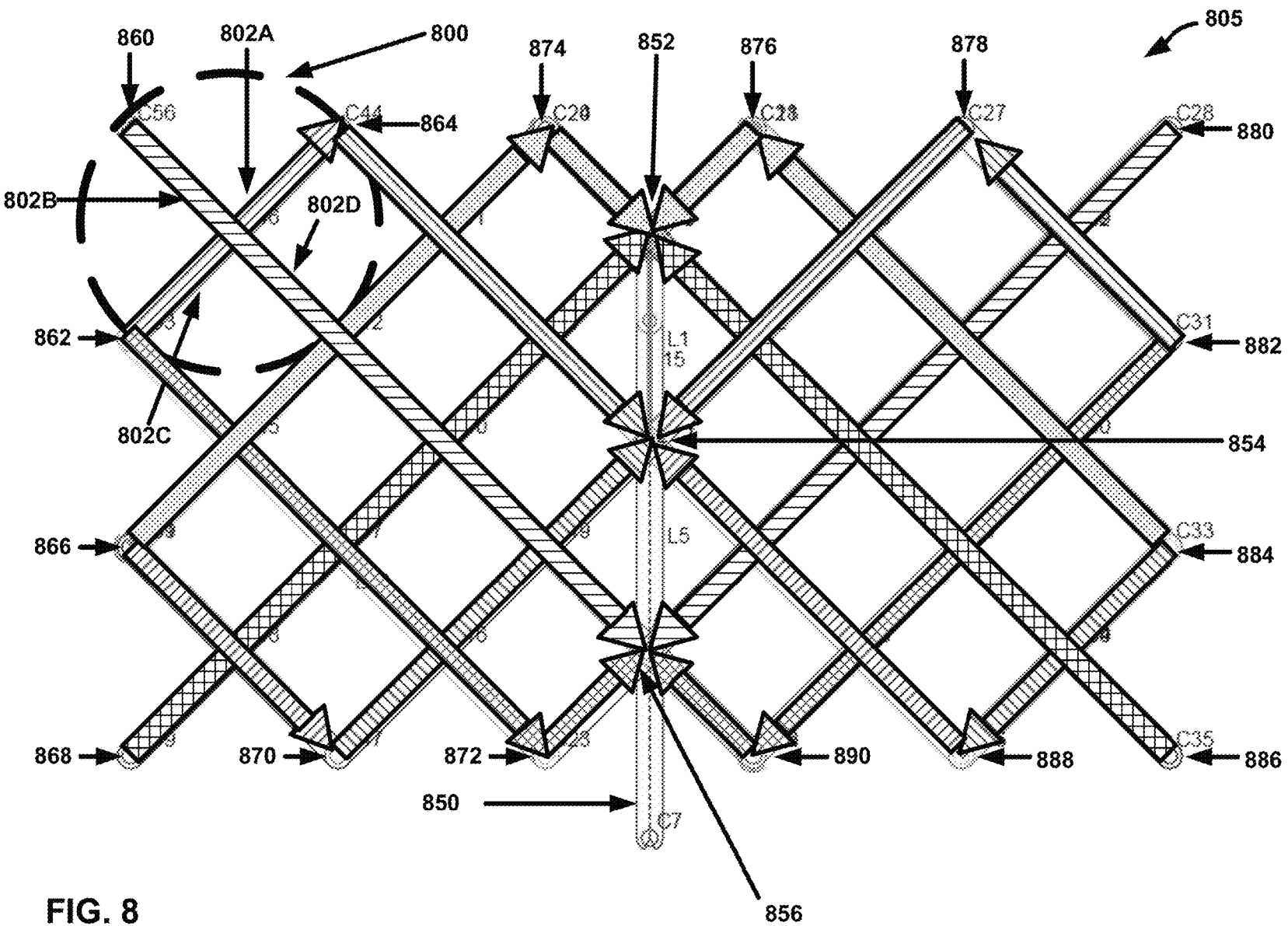
FIG. 8 is a diagram illustrating an example of beamforming functionality for an antenna array, in accordance with one or more aspects of the present disclosure.

Antenna array 705 can be one example of antenna array 605 shown in FIG. 6. Antenna array 705 includes fifteen distinct antenna systems, including antenna system 700, which can each be examples of antenna system 200 shown in FIG. 2. Antenna array 705 includes a deployment actuator 750, which can be one example of deployment actuator 650 of FIG. 6. Deployment actuator 750 can be coupled to the antenna systems in array 705 via summing junctions at C4, C14, and C15. These junctions can also comprise respective feedline ports 752, 754, and 756, as shown in FIG. 8.

Antenna array 705 can include electrical feedlines that operatively interconnect the connection members of the various antenna systems included in array 705, including antenna system 700. The feedlines can be coupled to one of feedline ports 752, 754, or 756, which are part of or coupled to deployment actuator 750. As will be described in further reference to FIG. 8, each of the feedlines couple two or more of the antenna systems of array 750 to a respective one of feedline ports 752, 754, or 756. Each of feedline ports 752, 754, and 756 can comprise a receiver port, a transmitter port, or a transceiver port.

As described earlier in reference to FIG. 2 and FIG. 6, each antenna system of array 705, including antenna system 700, includes four communication ports (e.g., communication ports 208 of antenna system 200, communication ports 608 of antenna system 600). Each of these communication ports can be include respective conductive and ground elements that are coupled respective an electrical feedline.

Antenna array 705 further includes a deployment actuator 750 that is coupled to at least some of the antenna systems in array 705. Deployment actuator 750 is configured, upon actuation, to switch antenna array 705 between a collapsed position and an expanded position for deployment. Antenna array 705 can be compacted by folding at the array element plane intersections. This flattened version of the lens can then be folded further, like an accordion, and fit into the cubesat of a satellite (e.g., satellite system 103). One or more benefits folded design are that feedline ports 752, 754, and 756 stay on the centerline of array 705. In some cases, array 705 can collapse to less than approximately 5% of the expanded or deployed volume, and when it is expanded, the deployed array 705 can be extremely rigid, maintaining certain tolerances for optimum performance.

For example, array 705 can be collapsed or expanded via actuation of deployment actuator 750 (e.g., motion of deployment actuator 750 and/or of a tensile member running through or within deployment actuator 750), causing corresponding folding or expansion of antenna system elements within array 705 at select top-side connection members (C44, C20, C21, C27), right-side connection member (C31, C33), bottom-side connection members (C36, C26, C23, C47), and left-side connection members (C59, C53).

FIG. 7A illustrates an expanded configuration in which antenna array 705 can operate to receive and/or transmit signals. Actuation of deployment actuator 750 can then cause antenna array 705 to begin collapsing into a fully collapsed or folded configuration. FIG. 7B illustrates an example intermediate configuration, in which antenna array 705 is at least partially collapsed. As indicated in FIG. 7B, motion of deployment actuator 750 causes folding of antenna system elements within array 705 at the select top-side connection members (C44, C20, C21, C27), right-side connection member (C31, C33), bottom-side connection members (C36, C26, C23, C47), and left-side connection members (C59, C53). Deployment actuator 750 can then continue to move antenna array 705 into a fully collapsed or folded configuration, as shown in FIG. 7C.

FIG. 8 is a diagram illustrating an example of beamforming functionality for an antenna array 806, in accordance with one or more aspects of the present disclosure. Antenna array 805 can be one example of array 705 (FIGS. 7A-7C) and/or array 605 (FIG. 6). Antenna array 805 further includes a deployment actuator 850 that is coupled to at least some of the antenna systems in array 605. Deployment actuator 850 is configured, upon actuation, to switch antenna array 805 between a collapsed position and an expanded position for deployment, similar to that illustrated for array 705 in FIGS. 7A-7C. For example, array 805 can be collapsed or expanded via actuation of deployment actuator 850 (e.g., motion of deployment actuator 850 and/or of a tensile member running through or within deployment actuator 850), causing corresponding folding or expansion of antenna system elements within array 805 at select top-side connection members (C44, C20, C21, C27), right-side connection member (C31, C33), bottom-side connection members (C36, C26, C23, C47), and left-side connection members (C59, C53).

Deployment actuator 850 can be coupled to the antenna systems in array 805 via summing junctions at C4 (856), C14 (854), and C15 (852). These junctions can also comprise feedline ports 856, 854, and 852, respectively, as shown in FIG. 8. FIG. 8 illustrates a beamforming approach to combine signals from the antenna systems of array 805 that can provide a simplified combiner design, which can also be adapted for distributed transmitter/receiver modules and digital beamforming.

Antenna array 805 can include electrical feedlines that operatively interconnect the connection members of the various antenna systems included in array 805. The feedlines can be coupled to one of feedline ports 852, 854, or 856, which are part of or coupled to deployment actuator 850. Each of the feedlines couple two or more of the antenna systems of array 850 to a respective one of feedline ports 852, 854, or 856. In some examples, respective additional feedlines coupled to each of feedline ports 852, 854, and 856 can also run through or inside deployment actuator 850. Each of feedline ports 852, 854, and 856 can comprise a receiver port, a transmitter port, or a transceiver port.

Each antenna system of array 805 includes four communication ports (e.g., communication ports 208 of antenna system 200, communication ports 608 of antenna system 600). Each of these communication ports can be include respective conductive and ground elements that are coupled respective an electrical feedline.

In some examples, the electrical feedlines that run through or are otherwise included in array 805 can include radio frequency combiners that are coupled to the various antenna systems in array 805, and which make up the beamforming network. Array 805 can be configured to perform beamforming of analog signals from the different antenna systems to feedline ports 852, 854, and 856 via the electrical feedlines, as shown in more detail in FIG. 8. In some cases, the electrical feedlines can include analog-to-digital converters that are coupled to the antenna systems, such that array 805 is configured to perform beamforming of digital signals from the antenna systems to feedline ports 852, 854, and 856 via the electrical feedlines.

In various examples, the electrical feedlines and beamforming network for antenna array 805 can combine signals from the various antenna pairs or sections of each four-antenna, antipodal Vivaldi antenna system that are co-planar and inverted relative to each other, and that provide approximately 180 degrees of phase shift between signals, independent of frequency. For instance, for the example antipodal Vivaldi antenna system 800 shown in FIG. 8, which can be one example of antenna system 200 (FIG. 2), a first set of electrical feedlines can combine one or more portions of signals from a first pair of antennas 802A and 802C (which can be examples of antennas 202A and 202C), and can also combine one or more portions of signals from a second pair of antennas 802B and 802D (which can be examples of antennas 202B and 202D). Each of antennas 802A-802D can have a respective communication port (e.g., communication ports 208A-208D shown in FIG. 2, communication ports 608A-608D shown in FIG. 6) that can be used for combining signals from respective pairs of antennas.

The beamforming network of electrical feedlines can similarly combine portions of signals from each of the pairs of antennas of the various antenna systems of array 805 that provide approximately 180 degrees of phase shift of signals, independent of frequency. Thus, for example, the electrical feedlines can combine the signals from antennas 802A and 802C with other pairs of antipodal Vivaldi antennas that are co-planar and inverted relative to each other, and that provide approximately 180 degrees of phase shift of signals between them. In various cases, and as indicated in FIG. 8, the different antenna systems having combined signals can be rotated relative to each other approximately 90 degrees, either in a clockwise (e.g., for one or more antenna systems located to the left of actuator 850 in FIG. 8) or counter-clockwise manner (e.g., for one or more antenna systems located to the right of actuator 850). All of the combined signals from different antennas and antenna systems of array 805 can be fed to one of feedline ports 852, 854, or 856, as also indicated in FIG. 8.

For example, as indicated in FIG. 8, a group of one or more electrical feedlines of array 805 run from region 860 to feedline port 856 to combine portions of signals from the various antenna pairs of the antenna systems in array 805, including antenna pair 802B and 802D, having respective communication ports that are positioned or otherwise included in the path provided by this group of feedlines. Another group of one or more feedlines of array 805 run from region 862 to region 864, and then to feedline port 854, to combine portions of signals from the various antenna pairs of the antenna systems in array 805, including antenna pair 802A and 802C, having respective communication ports that are positioned or otherwise included in the path provided by this group of feedlines.

As also indicated in FIG. 8, a group of one or more feedlines of array 805 run from region 862 to region 872, and then to feedline port 856, to combine portions of signals from the various antenna pairs having respective communication ports that are positioned or otherwise included in the path provided by this group of feedlines. Another group of one or more feedlines run from region 866 to region 874, and then to feedline port 852, to combine portions of signals from the various antenna pairs having respective communication ports that are positioned or otherwise included in the path provided by this group of feedlines. Another group of one or more feedlines run from region 868 to feedline port 852 to combine portions of signals from the various antenna pairs having respective communication ports that are positioned or otherwise included in the path provided by this group of feedlines. Another group of one or more feedlines run from region 866 to region 870, and then to feedline port 854, to combine portions of signals from the various antenna pairs having respective communication ports that are positioned or otherwise included in the path provided by this group of feedlines.

For antenna systems located to the right of actuator 850 in FIG. 8, a group of feedlines runs from region 884 to region 876, and then to feedline port 852, to combine portions of signals from the various antenna pairs having respective communication ports that are positioned or otherwise included in the path provided by this group of feedlines.

Another group of feedlines runs from region 886 to feedline port 852 to combine portions of signals from the various antenna pairs having respective communication ports that are positioned or otherwise included in the path provided by this group of feedlines. Another group of feedlines runs from region 882 to region 878, and then to feedline port 854, to combine portions of signals from the various antenna pairs having respective communication ports that are positioned or otherwise included in the path provided by this group of feedlines. Another group of feedlines runs from region 884 to region 888, and then to feedline port 854, to combine portions of signals from the various antenna pairs having respective communication ports that are positioned or otherwise included in the path provided by this group of feedlines.

Another group of feedlines runs from region 880 to feedline port 856 to combine portions of signals from the various antenna pairs having respective communication ports that are positioned or otherwise included in the path provided by this group of feedlines. Another group of feedlines runs from region 882 to region 890, and then to feedline port 856, to combine portions of signals from the various antenna pairs having respective communication ports that are positioned or otherwise included in the path provided by this group of feedlines.

As a result, antenna array 805 includes three distinct feedline ports 852, 854, and 856 at which portions of signals from various different antenna pairs of antenna system can be combined via the beamforming network of electrical feedlines. In some examples, portions of signals can be added to one another in the beamforming network of FIG. 8, when combining signals at feedline ports 852, 854, and 856, for right-handed circularly polarized signals. In other examples, portions of signals can be subtracted from one another in the beamforming network, when combining signals at feedline ports 852, 854, and 856, for left-handed circularly polarized signals. Each of feedlines ports 852, 854, and/or 856 can comprise a port for receiving signals and/or transmitting signals to a ground station (e.g., one or more of ground stations 107 shown in FIG. 1).

The techniques described in this disclosure can be implemented, at least in part, in hardware, software, firmware or any combination thereof. For example, various aspects of the described techniques can be implemented within one or more processors, including one or more microprocessors, digital signal processors (DSPs), application specific integrated circuits (ASICs), field programmable gate arrays (FPGAs), or any other equivalent integrated or discrete logic circuitry, as well as any combinations of such components. The term "processor" or "processing circuitry" can generally refer to any of the foregoing logic circuitry, alone or in combination with other logic circuitry, or any other equivalent circuitry. A control unit comprising hardware can also perform one or more of the techniques of this disclosure.

Such hardware, software, and firmware can be implemented within the same device or within separate devices to support the various operations and functions described in this disclosure. In addition, any of the described units, modules or components can be implemented together or separately as discrete but interoperable logic devices. Depiction of different features as modules or units is intended to highlight different functional aspects and does not necessarily imply that such modules or units must be realized by separate hardware or software components. Rather, functionality associated with one or more modules or units can be performed by separate hardware or software components, or integrated within common or separate hardware or software components.

One or more of the techniques described in this disclosure can also be embodied or encoded in a computer-readable medium, such as a computer-readable storage medium, containing instructions. Instructions embedded or encoded in a computer-readable medium can cause a programmable processor, or other processor, to perform the method, e.g., when the instructions are executed. Computer-readable media can include non-transitory computer-readable storage media and transient communication media. Computer readable storage media, which is tangible and non-transitory, can include random access memory (RAM), read only memory (ROM), programmable read only memory (PROM), erasable programmable read only memory (EPROM), electronically erasable programmable read only memory (EEPROM), flash memory, a hard disk, a CD-ROM, a floppy disk, a cassette, magnetic media, optical media, or other computer-readable storage media. The term "computer-readable storage media" refers to physical storage media, and not signals, carrier waves, or other transient media.

The invention claimed is:

1. An antenna system, comprising:

a connection member;

a first pair of antipodal Vivaldi antennas each coupled to the connection member, wherein the first pair of antipodal Vivaldi antennas are positioned co-planar with each other along a first plane and are inverted relative to each other, and wherein the first pair of antipodal Vivaldi antennas provide approximately 180 degrees of phase shift, independent of frequency, for a first group of signals; and a second pair of antipodal Vivaldi antennas each coupled to the connection member, wherein the second pair of antipodal Vivaldi antennas are positioned co-planar with each other along a second plane and are inverted relative to each other, wherein the second plane is substantially orthogonal to the first plane when the antenna system is deployed, and wherein the second pair of antipodal Vivaldi antennas provide approximately 180 degrees of phase shift, independent of frequency, for a second group of signals, wherein the antenna system is configured to utilize the first and second pairs of antipodal Vivaldi antennas to transmit or receive signals with circular polarization at least by beamforming the first group of signals from the first pair of antipodal Vivaldi antennas, via at least one summing junction, to the second group of signals from the second pair of the antipodal Vivaldi antennas.

2. The antenna system of claim 1, wherein:

the first pair of antipodal Vivaldi antennas positioned along the first plane includes first and second antipodal Vivaldi antennas;

the second pair of antipodal Vivaldi antennas positioned along the second plane includes third and fourth antipodal Vivaldi antennas;

the antenna system is configured to beamform the first group of signals at least by being configured to combine a first portion of signals from the first antipodal Vivaldi antenna with a second portion of signals from the second antipodal Vivaldi antenna; and the antenna system is configured to beamform the second group of signals at least by being configured to combine a third portion of signals from the third antipodal Vivaldi antenna with a fourth portion of signals from the fourth antipodal Vivaldi antenna.

3. The antenna system of claim 2, wherein:

the first and second antipodal Vivaldi antennas each have a top side with a conductive leaf and a bottom side with a ground leaf, wherein:

the top side with the conductive leaf of the first antipodal Vivaldi antenna is adjacent to the bottom side with the ground leaf of the second antipodal Vivaldi antenna, the bottom side with the ground leaf of the first antipodal Vivaldi antenna is adjacent to the top side with the conductive leaf of the second antipodal Vivaldi antenna, and the first and second antipodal Vivaldi antennas provide approximately 180 degrees of phase, independent of frequency, between the first portion of signals from the first antipodal Vivaldi antenna and the second portion of signals from the second antipodal Vivaldi antenna; and the third and fourth antipodal Vivaldi antennas each have a top side with a conductive leaf and a bottom side with a ground leaf, wherein:

the top side with the conductive leaf of the third antipodal Vivaldi antenna is adjacent to the bottom side with the ground leaf of the fourth antipodal Vivaldi antenna, the bottom side with the ground leaf of the third antipodal Vivaldi antenna is adjacent to the top side with the conductive leaf of the fourth antipodal Vivaldi antenna, and the third and fourth antipodal Vivaldi antennas provide approximately 180 degrees of phase, independent of frequency, between the third portion of signals from the third antipodal Vivaldi antenna and the fourth portion of signals from the fourth antipodal Vivaldi antenna.

4. The antenna system of claim 3, wherein:

the first antipodal Vivaldi antenna includes a first communication port having a conductive element coupled to the conductive leaf on the top side of the first antipodal Vivaldi antenna, and the first communication port further having a ground element coupled to the ground leaf on the bottom side of the first antipodal Vivaldi antenna;

the second antipodal Vivaldi antenna includes a second communication port having a conductive element coupled to the conductive leaf on the top side of the second antipodal Vivaldi antenna, and the second communication port further having a ground element coupled to the ground leaf on the bottom side of the second antipodal Vivaldi antenna;

the third antipodal Vivaldi antenna includes a third communication port having a conductive element coupled to the conductive leaf on the top side of the third antipodal Vivaldi antenna, and the third communication port further having a ground element coupled to the ground leaf on the bottom side of the third antipodal Vivaldi antenna; and the fourth antipodal Vivaldi antenna includes a fourth communication port having a conductive element coupled to the conductive leaf on the top side of the fourth antipodal Vivaldi antenna, and the fourth communication port further having a ground element coupled to the ground leaf on the bottom side of the fourth antipodal Vivaldi antenna.

5. The antenna system of claim 4, wherein:

the first communication port is positioned substantially in a middle of one end of the first antipodal Vivaldi antenna;

the second communication port is positioned substantially in a middle of one end of the second antipodal Vivaldi antenna;

the third communication port is positioned substantially in a middle of one end of the third antipodal Vivaldi antenna; and the fourth communication port is positioned substantially in a middle of one end of the fourth antipodal Vivaldi antenna.

6. The antenna system of claim 2, wherein the antenna system is configured to utilize the first and second pairs of antipodal Vivaldi antennas to transmit or receive the signals with the circular polarization by providing an approximate 90 degree phase shift of signals between the first antipodal Vivaldi antenna and the third antipodal Vivaldi antenna, an approximate 180 degree phase shift of signals between the first antipodal Vivaldi antenna and the second antipodal Vivaldi antenna, an approximate 270 degree phase shift of signals between the first antipodal Vivaldi antenna and the fourth Vivaldi antenna, and an approximate 90 degree of additional phase shift of signals between the fourth Vivaldi antenna and the first Vivaldi antenna.

7. The antenna system of claim 2, wherein:

the antenna system is configured to combine the first portion of signals from the first antipodal Vivaldi antenna with the second portion of signals from the second antipodal Vivaldi antenna at least by being configured to add the first portion of signals with the second portion of signals;

the antenna system is configured to combine the third portion of signals from the third antipodal Vivaldi antenna with the fourth portion of signals from the fourth antipodal Vivaldi antenna at least by being configured to add the third portion of signals with the fourth portion of signals; and the circular polarization comprises right-hand circular polarization.

8. The antenna system of claim 2, wherein:

the antenna system is configured to combine the first portion of signals from the first antipodal Vivaldi antenna with the second portion of signals from the second antipodal Vivaldi antenna at least by being configured to subtract one of the first or second portions of signals from the other;

the antenna system is configured to combine the third portion of signals from the third antipodal Vivaldi antenna with the fourth portion of signals from the fourth antipodal Vivaldi antenna at least by being configured to subtract one of the third or fourth portions of signals from the other; and the circular polarization comprises left-hand circular polarization.

9. The antenna system of claim 1, wherein the antenna system is included in a satellite.

10. The antenna system of claim 1, wherein the first and second pairs of antipodal Vivaldi antennas provide approximately 9 decibels (dB) of gain.

11. A foldable antenna array, comprising:

a plurality of antenna systems that are interconnected via a plurality of connection members; and a deployment actuator coupled to at least a group of the plurality of antenna systems, wherein the deployment actuator is configured, upon actuation, to switch the foldable antenna array between a collapsed position and an expanded position for deployment, and wherein each of the plurality of antenna systems comprises:

at least one connection member of the plurality of connection members;

a first pair of antipodal Vivaldi antennas each coupled to the at least one connection member, wherein the first pair of antipodal Vivaldi antennas are positioned co-planar with each other along a first plane and are inverted relative to each other, and wherein the first pair of antipodal Vivaldi antennas provide approximately 180 degrees of phase shift, independent of frequency, for a first group of signals; and a second pair of antipodal Vivaldi antennas each coupled to the at least one connection member, wherein the second pair of antipodal Vivaldi antennas are positioned co-planar with each other along a second plane and are inverted relative to each other, wherein the second plane is substantially orthogonal to the first plane when the foldable antenna array is in the expanded position, and wherein the second pair of antipodal Vivaldi antennas provide approximately 180 degrees of phase shift, independent of frequency, for a second group of signals, wherein the respective antenna system is configured to utilize the first and second pairs of antipodal Vivaldi antennas to transmit or receive signals with circular polarization at least by beamforming the first group of signals from the first pair of antipodal Vivaldi antennas, via at least one summing junction, to the second group of signals from the second pair of the antipodal Vivaldi antennas.

12. The foldable antenna array of claim 11, wherein each of the plurality of antenna systems further includes four communication ports that are each coupled to one of the antipodal Vivaldi antennas included in the first pair or the second pair, and wherein each of the four communication ports includes a conductive element and a ground element that are coupled to an electrical feedline.

13. The foldable antenna array of claim 11, further comprising:

a plurality of electrical feedlines that interconnect the plurality of connection members of the antenna systems, wherein each of the electrical feedlines is coupled to one of a plurality of feedline ports, wherein the plurality of feedline ports are coupled to the deployment actuator, and wherein each of the plurality of electrical feedlines couple two or more of the antenna systems to the respective one of the plurality of feedline ports.

14. The foldable antenna array of claim 13, wherein the plurality of antenna systems comprises fifteen antenna systems, and wherein the plurality of feedline ports comprises three feedline ports.

15. The foldable antenna array of claim 13, wherein the plurality of feedline ports comprises at least one of a receiver port, a transmitter port, or a transceiver port.

16. The foldable antenna array of claim 13, wherein the plurality of electrical feedlines includes a plurality of radio frequency combiners that are coupled to the plurality of antenna systems, and wherein the foldable antenna array is configured to perform beamforming of analog signals from the plurality of antenna systems to the plurality of feedline ports via the plurality of electrical feedlines.

17. The foldable antenna array of claim 13, wherein the plurality of electrical feedlines includes a plurality of analog-to-digital converters that are coupled to the plurality of antenna systems, and wherein the foldable antenna array is configured to perform beamforming of digital signals from the plurality of antenna systems to the plurality of feedline ports via the plurality of electrical feedlines.

18. The foldable antenna array of claim 11, wherein the antenna array is included in a satellite system.

19. The foldable antenna array of claim 11, wherein the foldable antenna array, based on an array factor gain, provides approximately 20.8 decibels (dB) of overall gain.

20. A satellite system, comprising:

a satellite;

a foldable antenna array comprising a plurality of antenna systems that are interconnected via a plurality of connection members; and a deployment actuator coupled to at least a group of the plurality of antenna systems, wherein the deployment actuator is configured, upon actuation, to switch the foldable antenna array between a collapsed position and an expanded position for deployment, and wherein each of the plurality of antenna systems comprises:

at least one connection member of the plurality of connection members;

a first pair of antipodal Vivaldi antennas each coupled to the at least one connection member, wherein the first pair of antipodal Vivaldi antennas are positioned co-planar with each other along a first plane and are inverted relative to each other, and wherein the first pair of antipodal Vivaldi antennas provide approximately 180 degrees of phase shift, independent of frequency, for a first group of signals; and a second pair of antipodal Vivaldi antennas each coupled to the at least one connection member, wherein the second pair of antipodal Vivaldi antennas are positioned co-planar with each other along a second plane and are inverted relative to each other, wherein the second plane is substantially orthogonal to the first plane when the foldable antenna array is in the expanded position, and wherein the second pair of antipodal Vivaldi antennas provide approximately 180 degrees of phase shift, independent of frequency, for a second group of signals, wherein the respective antenna system is configured to utilize the first and second pairs of antipodal Vivaldi antennas to transmit or receive signals with circular polarization at least by beamforming the first group of signals from the first pair of antipodal Vivaldi antennas, via at least one summing junction, to the second group of signals from the second pair of the antipodal Vivaldi antennas.

* * * * *